US010914131B2

(12) United States Patent
Chau et al.

(10) Patent No.: US 10,914,131 B2
(45) Date of Patent: Feb. 9, 2021

(54) MECHANICAL ROTATING CONTROL DEVICE LATCH ASSEMBLY

(71) Applicant: Halliburton Energy Services, Inc., Houston, TX (US)

(72) Inventors: Christopher J. Chau, Plano, TX (US); Christopher Allen Grace, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 236 days.

(21) Appl. No.: 16/065,589

(22) PCT Filed: Feb. 12, 2016

(86) PCT No.: PCT/US2016/017738
§ 371 (c)(1),
(2) Date: Jun. 22, 2018

(87) PCT Pub. No.: WO2017/138953
PCT Pub. Date: Aug. 17, 2017

(65) Prior Publication Data

US 2019/0136655 A1 May 9, 2019

(51) Int. Cl.

| | |
|---|---|
| ***E21B 23/00*** | (2006.01) |
| ***E21B 33/038*** | (2006.01) |
| ***E21B 33/08*** | (2006.01) |

(52) U.S. Cl.
CPC ..... *E21B 33/085* (2013.01); *E21B 23/006* (2013.01); *E21B 33/038* (2013.01)

(58) Field of Classification Search
CPC .... E21B 23/004; E21B 23/006; E21B 33/085; E21B 33/038
See application file for complete search history.

(56) References Cited

U.S. PATENT DOCUMENTS

| | | | | |
|---|---|---|---|---|
| 3,819,282 | A | 6/1974 | Schultz | |
| 4,256,179 | A * | 3/1981 | Shillander | E21B 34/12 166/237 |
| 4,276,931 | A * | 7/1981 | Murray | E21B 21/103 166/169 |
| 7,946,361 | B2 * | 5/2011 | Gurjar | E21B 7/067 175/101 |
| 2004/0112644 | A1 * | 6/2004 | Chan | E21B 34/12 175/57 |
| 2004/0129430 | A1 | 7/2004 | Tessier et al. | |
| 2006/0108119 | A1 | 5/2006 | Bailey et al. | |

(Continued)

OTHER PUBLICATIONS

International Search Report and the Written Opinion for International Application No. PCT/US2016/017738 dated Nov. 24, 2016, 14 pages.

*Primary Examiner* — Robert E Fuller
(74) *Attorney, Agent, or Firm* — Chamberlain Hrdlicka

(57) ABSTRACT

A remotely and mechanically actuated RCD control tool adjusts at least one component of an RCD latch assembly between at least two settings. The mechanical RCD control tool comprises a rotational cylinder and a guide cylinder, the rotational cylinder configured to rotate in a rotational direction to adjust the RCD latch assembly from a first setting to a second setting and from the second setting to the first setting based on movement of the drive cylinder in a selected direction. Additional apparatus, methods, and systems are disclosed.

11 Claims, 11 Drawing Sheets

(56) References Cited

U.S. PATENT DOCUMENTS

| | | | | |
|---|---|---|---|---|
| 2010/0193196 | A1* | 8/2010 | McGarian | E21B 23/004 166/373 |
| 2010/0212886 | A1* | 8/2010 | Hall | E21B 23/004 166/194 |
| 2012/0318496 | A1 | 12/2012 | Bailey et al. | |
| 2015/0292281 | A1 | 10/2015 | Hardin, Jr. et al. | |
| 2015/0337628 | A1 | 11/2015 | Johnson et al. | |
| 2016/0115767 | A1* | 4/2016 | Watson | E21B 23/004 166/373 |
| 2017/0044858 | A1* | 2/2017 | Evans | E21B 43/10 |
| 2017/0328145 | A1* | 11/2017 | Wagoner | E21B 19/002 |

* cited by examiner

MECHANICAL ROTATING CONTROL DEVICE LATCH ASSEMBLY

BACKGROUND

In some oilfield operations, a device such as a Rotating Control Device (RCD) may be used to seal the annulus for closed-annulus drilling operations, such as managed pressure drilling, underbalanced drilling, mud cap drilling, pressurized mud cap drilling, air drilling, mist drilling, or the like. RCD's can also be used as additional safety barriers when drilling conventionally. Some conventional RCD operations involve tool-specific running instruments to install RCD tools within the RCD body and tool-specific retrieving instruments to uninstall RCD tools from the RCD body. Some conventional RCD systems use shear pin mechanisms that are redressed after each actuation to set and unset components of the RCD. Some conventional RCD systems utilize an external power source to set and unset components of the RCD. Some conventional RCD systems are bulky. Some conventional RCD systems are not able to provide one or more desired seals within the RCD. Thus, current systems can result in inefficiencies, insufficient seals, limited real estate due to the physical footprint of the system, or other costs.

BRIEF DESCRIPTION OF THE DRAWING

The present disclosure may be better understood, and its numerous features and advantages made apparent to those of ordinary skill in the art by referencing the accompanying drawings. The use of the same reference symbols in different drawings indicates similar or identical items.

DETAILED DESCRIPTION

FIGS. 1-8 illustrate example apparatus, systems, and methods related to a rotating control device (RCD) system. The RCD system generally includes a body, a latch assembly, and one or more RCD tools. The latch assembly includes a sealing element to form a seal between the RCD tools and the body, a latch to latch the RCD tools to the body, and a mechanical RCD control tool to facilitate remote and mechanical control of at least one of the sealing element and the latch. The mechanical RCD control tool includes a rotational cylinder, a drive cylinder, and a guide cylinder which interact to adjust an RCD between at least two settings responsive to longitudinal force applied to the drive cylinder. In at least one example, rotational teeth of the rotational cylinder interact with drive teeth of the drive cylinder and angled guide edges of the guide cylinder to control rotation of the rotational cylinder. The mechanical RCD control tool is a remote and mechanically-actuated mechanism that does not require supplemental power (e.g., hydraulics, pneumatics, electricity, or the like). Further, embodiments of the present RCD system allow for repeated actuation (adjustment) without redressing.

Figure 1:
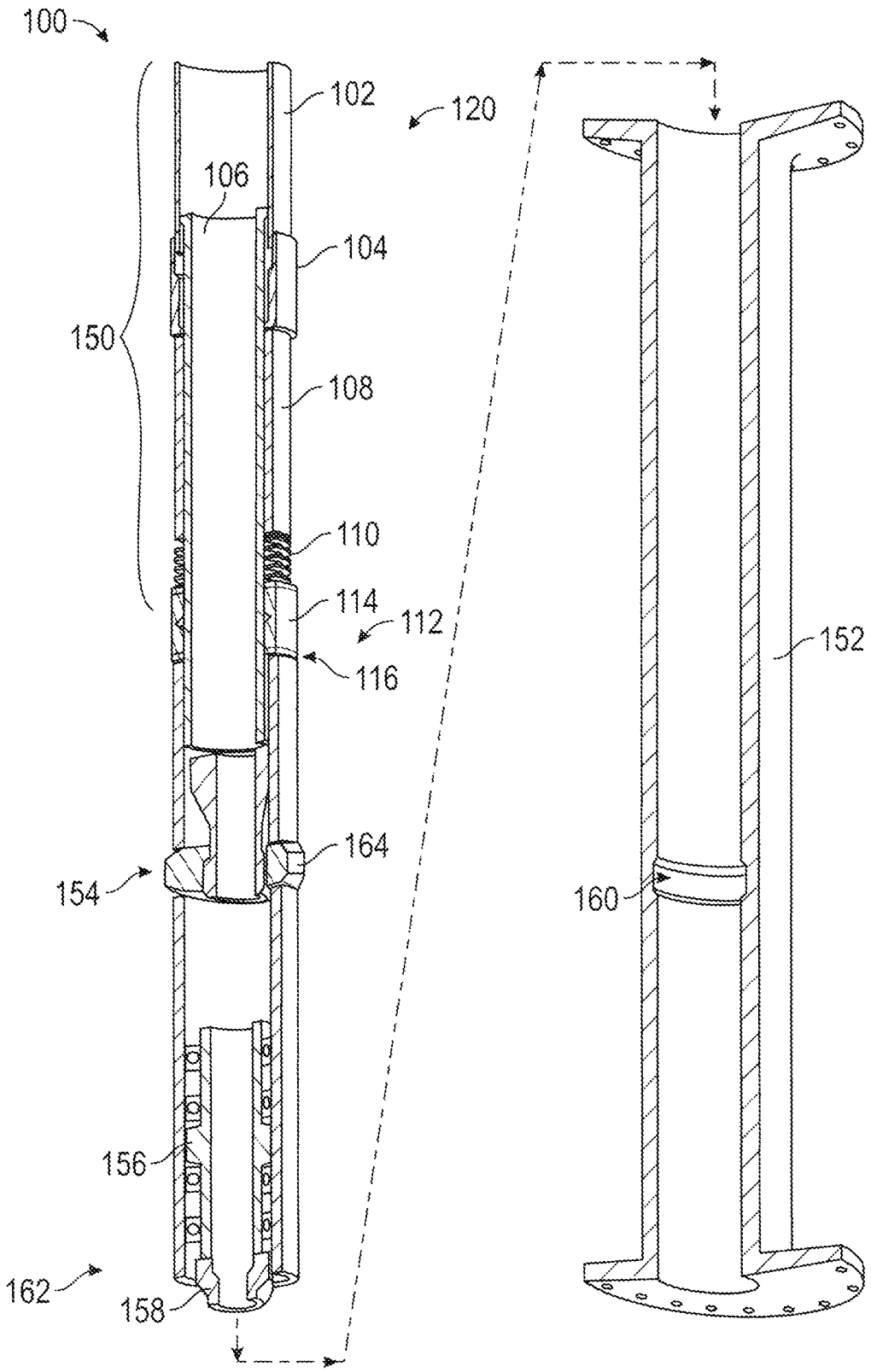
FIG. 1 is a cross-sectional view of an example rotating control device (RCD) system, in accordance with some embodiments.

FIG. 1 depicts an example rotating control device (RCD) system 100, in accordance with some embodiments. When drilling underbalanced (below formation pressure) or managed pressure (equal the formation pressure respectively) an RCD can be used to create a seal between the drill string and annulus (to enable dynamic pressure control in the wellbore). The RCD system 100 comprises a latch assembly 120, an RCD body 152, and an RCD tool 162. The latch assembly 120 includes a mechanical RCD control tool 150 and one or more latch assembly components, for example, a seal 112 and a latch 154. The body 152 houses the latch assembly 120 and tool 162 and diverts flow. The latch 154 allows tools 162 to be installed into, and uninstalled from, the body 152. The tool 152 can comprise any of a variety of tools configured to perform any of a variety of functions. In the illustrated embodiment, the tool 162 is a bearing assembly 156 configured to allow drill pipe to spin inside the RCD body 152 while holding a seal, via sealing element 158, between the RCD 162 and the drill pipe. In at least one embodiment, the tool 162 comprises an inner housing with a rotating member 156, such that the RCD body 152 is configured to receive the inner housing with the rotating member 156. In at least one embodiment, the latch assembly is configured to couple the inner housing with the rotating member 156 to the RCD body 152.

Some conventional RCD's use O-rings or V-packings to seal between the tools and the RCD body, which often involve maintaining pristine sealing surfaces and frequent redressing for reliability. Surface conditions for offshore operations (e.g., jack up and floating rigs) may not support the reliable operation of these types of seals (e.g., which function well when tight tolerances with smooth surfaces are present). O-ring and V-packing type seals also often involve close mating components to establish sealing surfaces with very small extrusion gaps. Due to the location of the RCD's in marine drilling risers and drift and gauge requirements of inside diameter (ID) and outside diameter (OD) components, it may not be possible to achieve such tight extrusion gaps using conventional systems and methods.

In some embodiments, the latch assembly 120 includes a sealing element 112, such as a packer element 114, that can be remotely and mechanically operated via the mechanical RCD control tool 150, allowing for more reliable sealing in offshore operations. In some embodiments, the RCD control tool 150 includes a drive cylinder 102, a rotational cylinder 104, and a guide cylinder 106. In some embodiments, the RCD control tool 150 includes an intermediate cylinder 108 disposed between a bias element 110 and the rotational cylinder 104. In at least one embodiment, the intermediate cylinder 108 transfers forces between the rotational cylinder 104 and the bias element 110. In some embodiments, the rotational cylinder 104 is directly coupled to the bias element 110, and an intermediate cylinder 108 is not included.

In some embodiments, the RCD control tool 150 is configured to interact with one or more of the components (e.g. the sealing element 112 or the latch 154) of the latch assembly 120 to adjust the component 112, 154 between at least two settings. For example, in at least one embodiment the RCD control tool 150 can adjust the component 112, 154 back and forth between active and inactive positions. In some embodiments, the RCD control tool 150 can adjust the component 112, 154 between more than two settings. In at least one embodiment, the RCD control tool 150 can cycle repeatedly through a plurality of settings for the component 112, 154. In some embodiments, the RCD control tool 150 can set and unset the component 112, 154.

In the illustrated embodiment, the sealing element 112 includes a packer element 114 and a packer retaining ring 116, such that the RCD system 100 can adjust the packer element 114 from a compressed configuration to an uncompressed configuration and from the uncompressed configuration to the compressed configuration. In the present disclosure, the terms "compressed" and "uncompressed" are relative terms, such that "compressed" means more compressed and "uncompressed" means less compressed. In at least one embodiment, the combination of the RCD control tool 150 and the packer element 114 allow an operator to maintain a seal between the RCD body 152 and a tool 162 (e.g., bearing assembly, casing stripper adapter, seal bore protector, or the like) installed in the RCD body 152 without the need for tight tolerances or pristine sealing surface conditions.

In at least one embodiment, the mechanical RCD control tool 150 adjusts the latch 154 from a latched configuration to an unlatched configuration and from the unlatched configuration to the latched configuration. In some embodiments, the latch 154 is a rotary cam latch. In at least one embodiment, the rotary cam latch 154 is configured to spin to cause latch dogs 164 to protrude and retract to set and unset tools within the RCD body 152. When the mechanical RCD control tool 150 adjusts the latch dogs 164 from the retracted configuration to the protruding configuration, the latch dogs 164 engage a corresponding profile 160 (e.g., a recess) in the RCD body 152.

Figure 2:
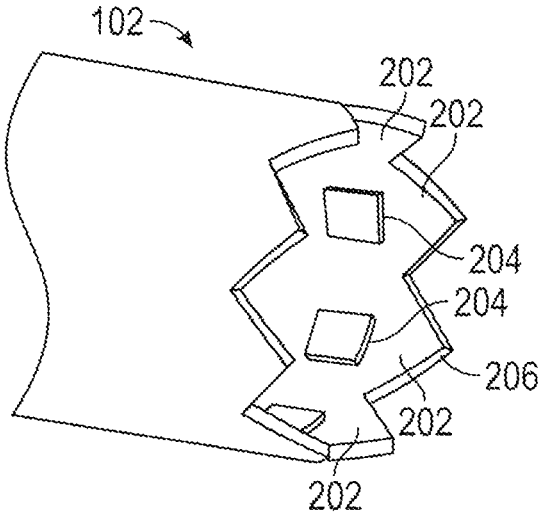
FIG. 2 is a perspective view of an example drive cylinder of the example RCD system of FIG. 1, in accordance with some embodiments.

FIG. 2 depicts an example drive cylinder 102 of the example RCD system 100 of FIG. 1, in accordance with some embodiments. In the illustrated embodiment, the drive cylinder 102 includes a plurality of drive teeth 202 and a plurality of lugs 204. In some embodiments, each of the plurality of drive teeth 202 includes an angled surface 206. In some embodiments, each of the plurality of drive teeth 202 includes more than one angled surface 206. In at least one embodiment, the plurality of drive teeth 202 are configured to interact with the rotational cylinder 104. In some embodiments, the plurality of lugs 204 are configured to interact with the guide cylinder 106. In some embodiments, the drive cylinder 102 does not include the plurality of lugs 204.

Figure 3:
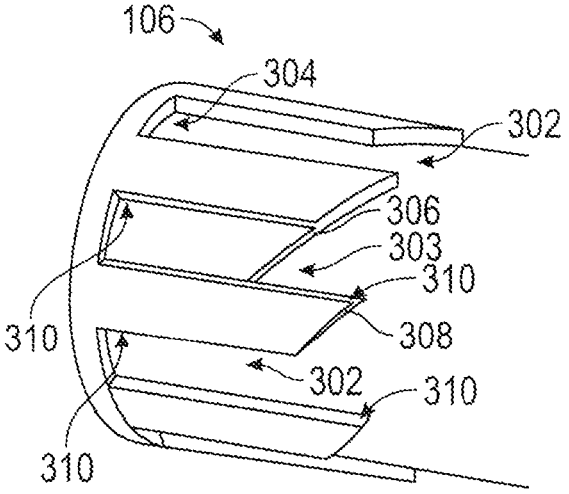
FIG. 3 is a perspective view of an example guide cylinder of the example RCD system of FIG. 1, in accordance with some embodiments.

FIG. 3 depicts an example guide cylinder 106 of the example RCD system 100 of FIG. 1, in accordance with some embodiments. In some embodiments, the guide cylinder 106 includes locking elements 302, 303 to selectively prevent movement of the drive cylinder 102. In the illustrated embodiment, the locking elements 302, 303 includes a plurality of slots. The plurality of slots are configured to receive and guide the plurality of lugs 204 of the drive cylinder 102. In at least one embodiment, the locking elements 302, 303 is configured to selectively prevent rotational movement of the drive cylinder 102 in at least one direction, for example, when the lugs 204 are within the slots. In some embodiments, the locking elements 302, 303 is configured to selectively prevent longitudinal movement of the drive cylinder 102. For example, in the illustrated embodiment, each of the plurality of slots of the locking elements 302, 303 includes a stop surface 304 to prevent the drive cylinder 102 from moving in a longitudinal direction once the lugs 204 engage the stop surfaces 304. In some embodiments, the locking elements 302, 303 is configured to selectively prevent rotational movement of the drive cylinder 102. For example, in the illustrated embodiment, each of the plurality of slots of the locking elements 302, 303 includes walls 310 to prevent the drive cylinder 102 from rotating when the lugs 204 engage any of the walls 310.

In some embodiments, the guide cylinder 106 includes a plurality of angled edges 306, 308. In at least one embodiment, the plurality of angled edges 306, 308 include a set of deep angled edges 306 and a set of shallow angled edges 308, such that at least a portion of each deep angled edge 306 is positioned deeper than the shallow angled edges 308. In some embodiments, at least a portion of each deep angled edge 306 is positioned upward relative to the shallow angled edges 308. In some embodiments, the angled edges 306 vary in thickness (radial diameter). In some embodiments, each deep angled edge 306 includes a thin portion and a thick portion. In at least one embodiment, the thin portion is positioned deeper than the thick portion.

In some embodiments, a first set of the locking elements 303 are formed at a different radial depth than a second set of the locking elements 302 to form the deep portion of the deep angled edge 306. In at least one embodiment, the first set of locking elements 303, which include a portion of the deep angled edge 306, has an outside diameter (OD) greater than an inside diameter (ID) of the rotational teeth 402. In at least one embodiment, the second set of locking elements 302 has an OD less than the ID of the rotational teeth 402. In some embodiments, the varying depth of the locking elements 302, 303 allows the lugs 204 to pass through the first and second set of locking elements 303, 302 to the base of the guide cylinder 106 but prevents the rotational teeth 402 from passing through the first set of locking elements 303 (since the angled edge 404 of the rotational teeth 402 abuts the deep angled edge 306).

Figure 4:
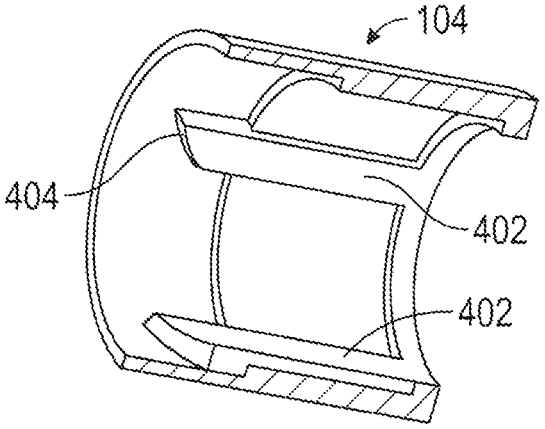
FIG. 4 is a cross-sectional view of an example rotational cylinder of the example RCD system of FIG. 1, in accordance with some embodiments.

FIG. 4 depicts an example rotational cylinder 104 of the example RCD system 100 of FIG. 1, in accordance with some embodiments. In some embodiments, the rotational cylinder 104 includes a plurality of rotational teeth 402. The plurality of rotational teeth 402 are configured to engage the drive teeth 202 of the drive cylinder 102 and the slots 302 and angled edges 306, 308 of the guide cylinder 106. For example, in at least one embodiment, the angle of a surface 404 of each of the plurality of rotational teeth 402 substantially corresponds to the angle of a surface 206 of each of the plurality of drive teeth 202, and an angle of the angled edges 306, 308. In at least one embodiment, the slots 302, or other locking element, are configured to selectively prevent rotation of the rotational cylinder 104. In at least one embodiment, the RCD system 100 includes more angled edges 306, 308 than rotational teeth 402. In at least one embodiment, the too control system 100 includes twice as many angled edges 306, 308 as rotational teeth 402.

In at least one embodiment, the angled surfaces 206 of the drive teeth 202 are at the same angle as the surfaces of angled edges 306, 308. In at least one embodiment, the angle of the angled surface 404 of rotational teeth 402 corresponds to the angle of the drive teeth 202 and the angled edges 306, 308.

In the illustrated example of FIGS. 1-4, the guide cylinder 106 is positioned interior to the drive cylinder 102 and the rotational cylinder 104, and the drive cylinder 102 is at least partially positioned interior to the rotational cylinder 104. As such, the plurality of angled edges 306, 308 and the walls 310 are positioned on an exterior surface of the guide cylinder 106. However, other configurations will be understood by those of ordinary skill in the art without requiring further enumeration of each possible configuration. The drive cylinder 102, the rotational cylinder 104 and the guide cylinder 106 operate to adjust at least one component of the latch assembly 120 (e.g. sealing element 112, latch 154) between at least two settings based solely on mechanical engagement.

FIGS. 5A-5G depict the example RCD system 100 of FIG. 1 in various operational positions, in accordance with some embodiments. Each of FIGS. 5A-5G show the interaction between the drive cylinder 102, rotational cylinder 104, and guide cylinder 106, as well as the corresponding configuration of the bias element 110, and packer element 114. FIGS. 5A-5G show the RCD system 100 responsive to application and reduction (or removal) of longitudinal forces applied to the drive cylinder 102 in a selected direction. Generally, application and reduction of a longitudinal force causes the drive cylinder 102 to move in the longitudinal direction the rotational cylinder 104 to move both rotationally and in the longitudinal direction, and the bias element 110 to compress and extend (decompress), while the guide cylinder 106 generally maintains its position.

For ease of understanding, the RCD system 100 is described with regard to a configuration for operation with a longitudinal force in a downward direction; however, it will be understood by those of ordinary skill in the art that the RCD system 100 could be similarly configured for operation with a longitudinal force in an upward direction based on the teachings of the present disclosure. Further, downward and upward as used herein are relative terms that can differ depending on orientation. The illustrated embodiments depict an example of the RCD control device 150 adjusting the sealing element 112. However, in other embodiments, the RCD control device 150 could similarly be configured to adjust the latch 154, or both the sealing element 112 and the latch 154.

Figure 5A:
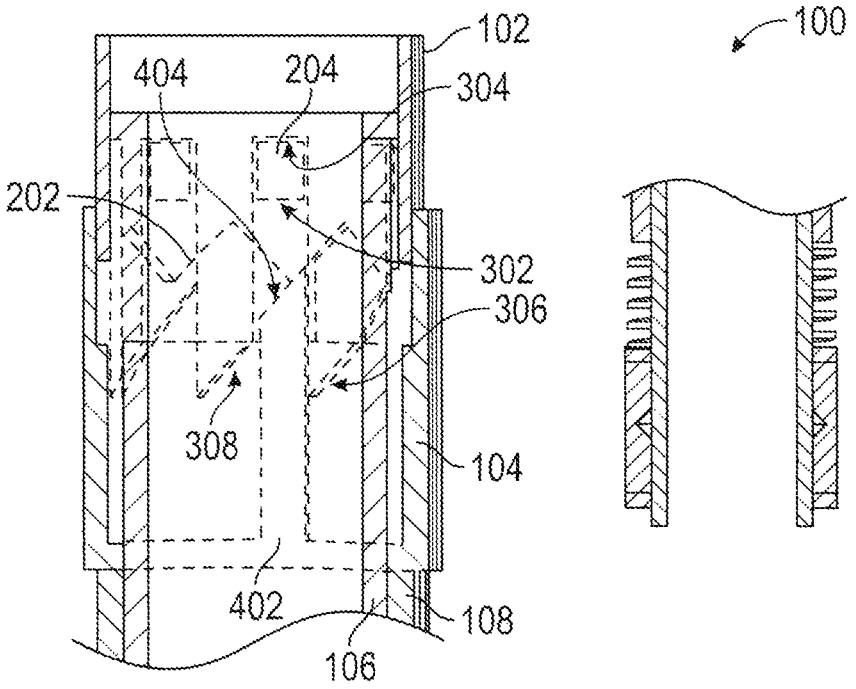
FIGS. 5A-5G are cross-sectional views of the example RCD system of FIG. 1 in various operational positions, in accordance with some embodiments.

FIG. 5A shows the RCD system 100 in a resting state, or a running configuration, without the application of a longitudinal force on the drive cylinder 102. The bias 110 is in an uncompressed position, providing an upward force to the rotational cylinder 104. The packer 110 is also in an uncompressed position. In the illustrated embodiment, the rotational teeth 402 of the rotational cylinder 104 are within the slots 302 of the guide cylinder 106 and engaged with the drive teeth 202 of the drive cylinder 102, such that the guide cylinder 106 prevents rotational movement of the rotational cylinder 104. The lugs 204 of the drive cylinder 102 are abutting the stop surface 304 of the guide cylinder 106 slots 302, such that the drive cylinder 102 is prevented from moving further upward. In some embodiments, the rotational teeth 402 do not engage the drive teeth 202 in the running configuration.

Figure 5B:
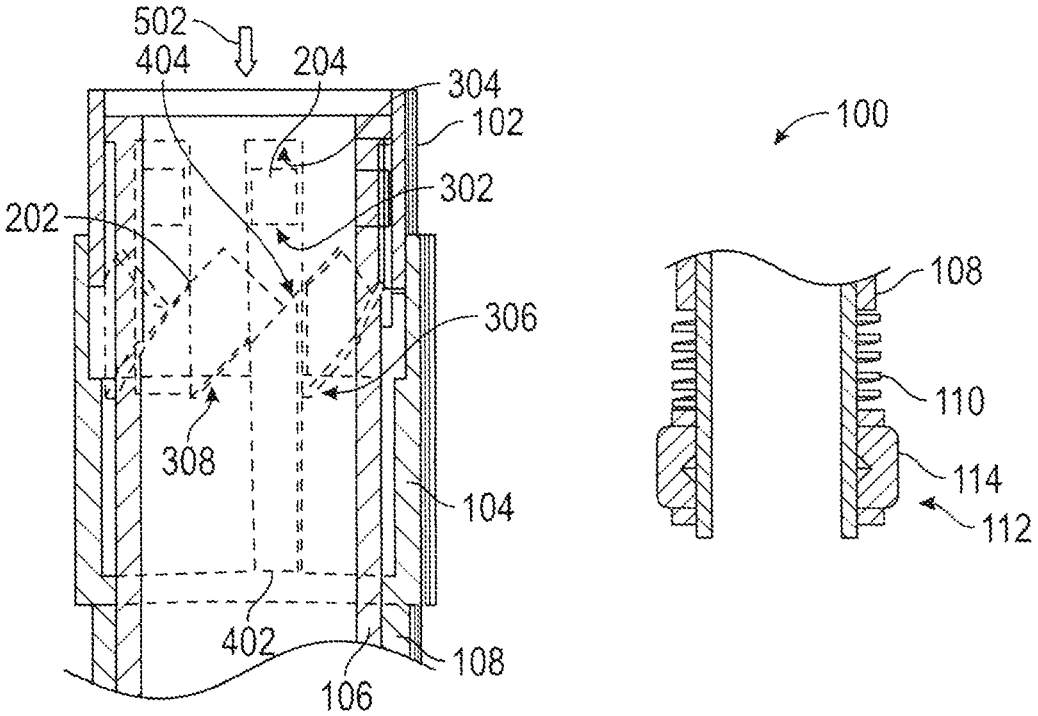

FIG. 5B shows a packer setting configuration in which the RCD system 100 set the Sealing element 112, in the illustrated example a packer element 114, responsive to a first downward longitudinal force 502. The downward longitudinal force 502 urges the drive cylinder 102 in the downward direction. The lugs 204 no longer abut the stop surface 304, but are still positioned within the slots 302, such that the guide cylinder 106 prevents rotation of the drive cylinder 102. The drive teeth 202 engage the rotational teeth 402, such that the drive cylinder 102 urges the rotational cylinder 104 in the downward direction. The rotational cylinder urges (in some examples, via the intermediate cylinder 108) the bias element 110 to compress. In the illustrated embodiment, the bias element 110 is a spring with a spring rate such that the downward longitudinal force 502 does not compress the element 110. As such, in the illustrated embodiment, the downward longitudinal force 502 causes the packer element 114 to compress.

Figure 5C:
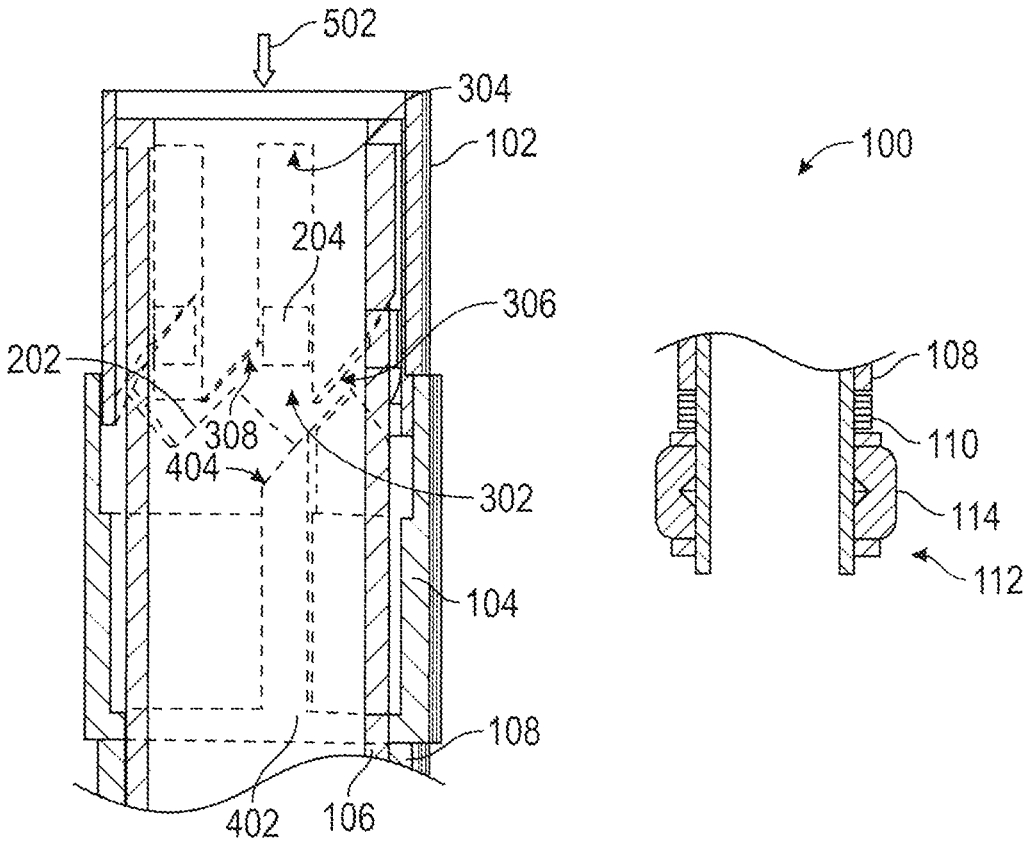

FIG. 5C shows the RCD system 100 in a fully depressed locking configuration, in which downward longitudinal force 502 causes the bias element 110 to compress in addition to the packer element 114. As the downward longitudinal force 502 moves the drive cylinder 102 and the rotational cylinder 104 downward, the rotational teeth 402 disengage the slots 302 of the guide cylinder 106, such that the guide cylinder 106 no longer prevents rotation of the rotational cylinder 104. As such, as the drive cylinder 102 and the rotational cylinder 104 are urged against one another, the corresponding angled surfaces 206, 404 of the drive cylinder 102 and the rotational cylinder 104, respectively, cause the rotational cylinder 104 to rotate. While the illustrated embodiments depict the angles such that the rotational cylinder 104 rotates clockwise, it will be easily understood by those of ordinary skill in the art how to adjust the configuration for counter-clockwise rotation.

Figure 5D:
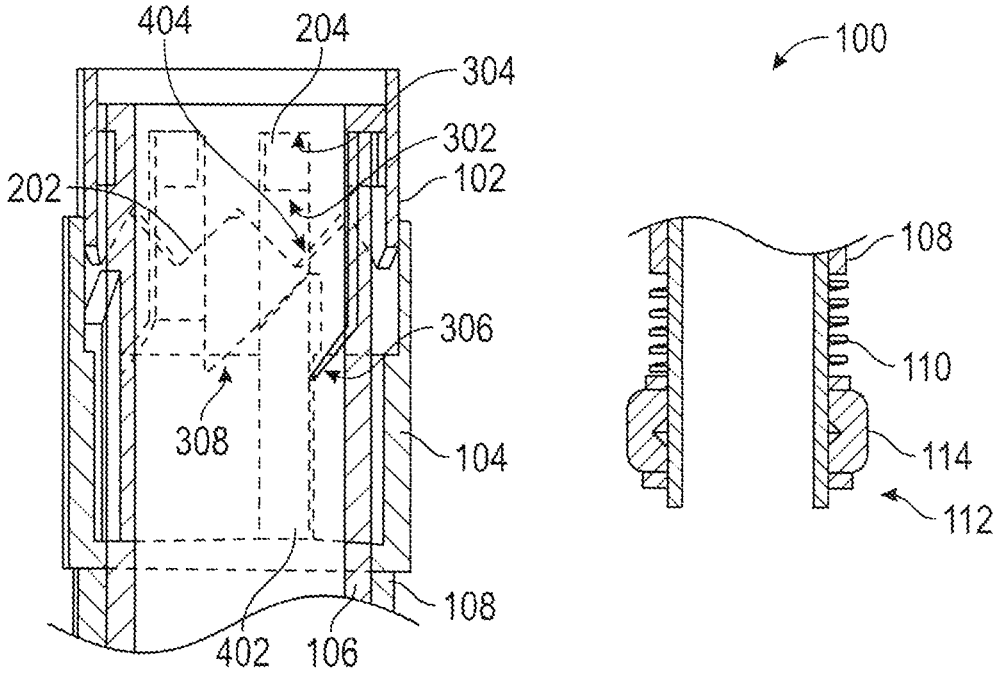

FIG. 5D shows the RCD system 100 in a locked configuration, in which the RCD system 100 responds to a reduction in (or removal of) the downward longitudinal force 502. In at least one embodiment, an external force is applied to pull, or otherwise move the drive cylinder 102 upward. The bias element 110 is allowed to extend and urges the rotational cylinder 104 in the upward direction until the rotational teeth 402 engage one or more of the angled edges 306, 308 of the guide cylinder 106. In at least one embodiment, the rotational teeth 402 engage a plurality of deep angled edges 308. In at least one embodiment, the drive cylinder 102 is not subjected to the downward longitudinal force 502 or the force of the bias element 110 while the RCD system 100 is in the locked configuration. The rotational teeth 402 travel along the angled edges 308, causing the rotational cylinder 104 to rotate until it abuts a wall 310. In some embodiments, an additional stopping element can be provided, other than the wall 310 of the slot 302. The packer element 114 remains compressed, while the uncompressed spring exerts an upward force to secure the rotational cylinder 104 in its position relative to the guide cylinder 106. At the locked configuration, the RCD system 100 has set the packer element 114. When an operator desires to unset the packer element 114, the operator can apply a subsequent force to the drive cylinder 102.

Figure 5E:
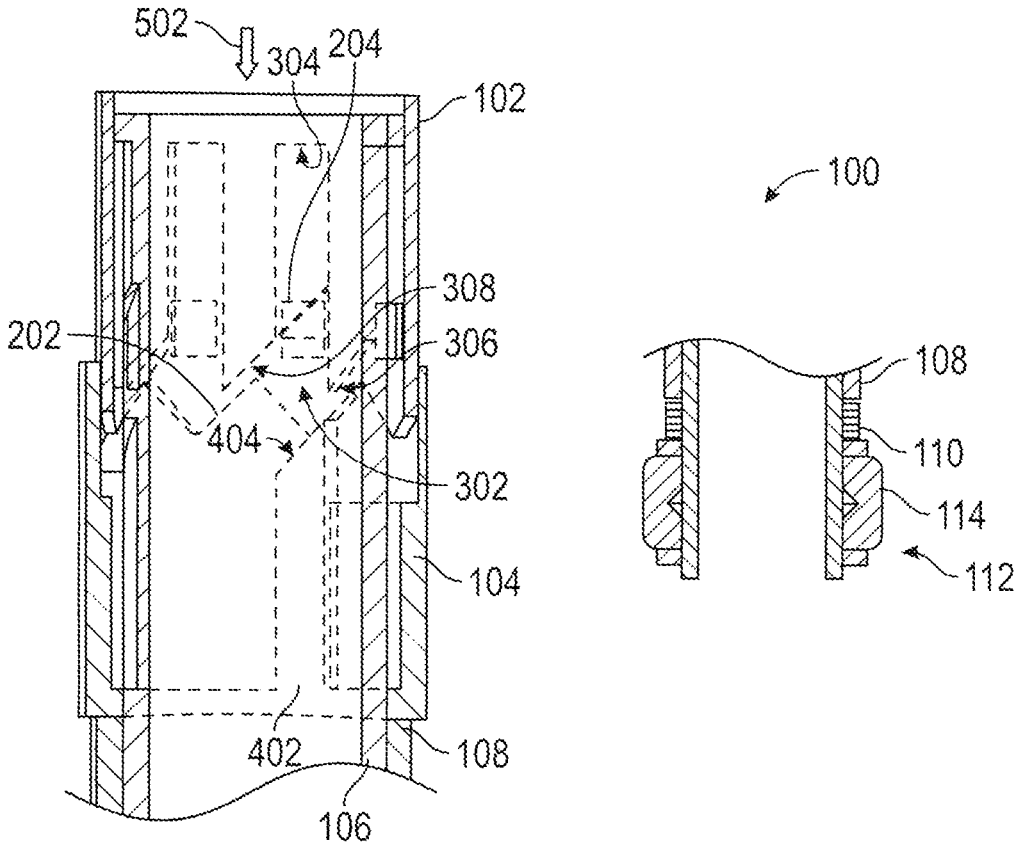

FIG. 5E shows the RCD system 100 in a fully depressed unlocking configuration, in which the RCD system 100 responds to a second downward longitudinal force 504. The drive teeth 202 engage the rotational teeth 402, and as the second downward longitudinal force 504 urges the drive cylinder 102 downward, the drive cylinder 102 urges the rotational cylinder 104 downward, compressing the bias element 110. When the rotational teeth 402 pass the walls 310 of the guide cylinder 106 that were preventing rotation of the rotational cylinder 104, the rotational teeth 402 are allowed to slide along the angled surface 206 of the drive teeth 202 to rotate the rotational cylinder 104.

Figure 5F:
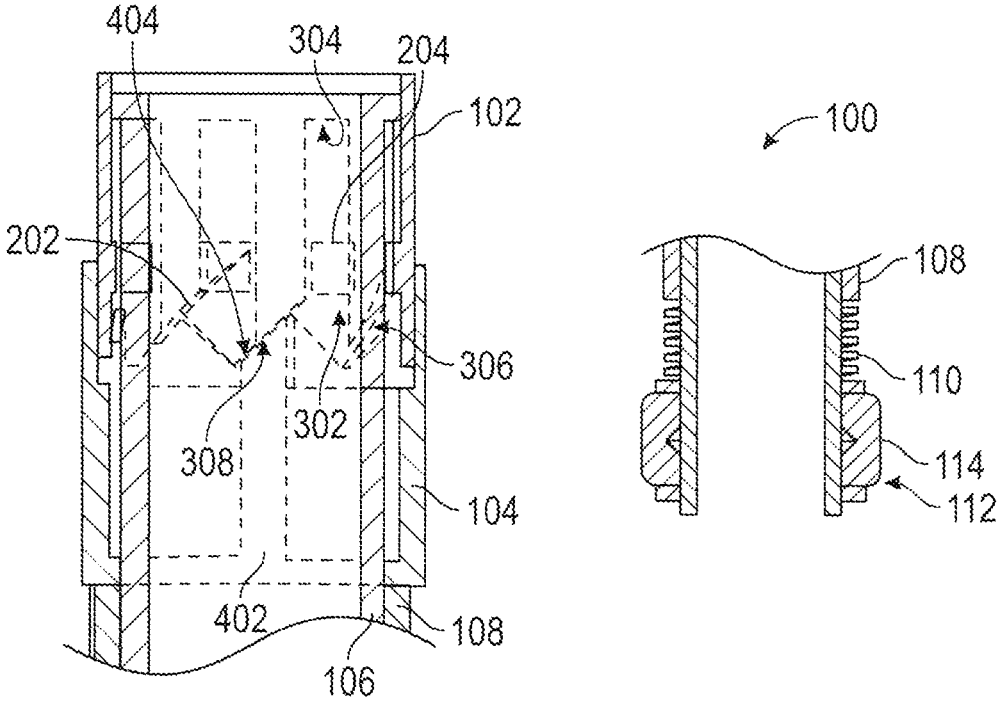

FIG. 5F shows the RCD system 100 in a lock-release configuration, in which the RCD system 100 responds to a reduction in (or removal of) the second downward longitudinal force 504. In at least one embodiment, an upward force moves the drive cylinder 102 in the upward direction, and the bias element 110 is allowed to extend, urging the rotational cylinder 104 in the upward direction until the rotational teeth 402 engage one or more of the angled edges 306, 308 of the guide cylinder 106. In at least one embodiment, the rotational teeth 402 engage a plurality of shallow angled edges 306. In at least one embodiment, the drive cylinder 102 is not subjected to the downward longitudinal force 502 or the upward force while the RCD system 100 is in the lock-release configuration. The rotational teeth 402 travel along the angled edges 306, causing the rotational cylinder 104 to rotate until it abuts a wall 310 (or other stopping element) while the packer element 114 remains compressed.

Figure 5G:
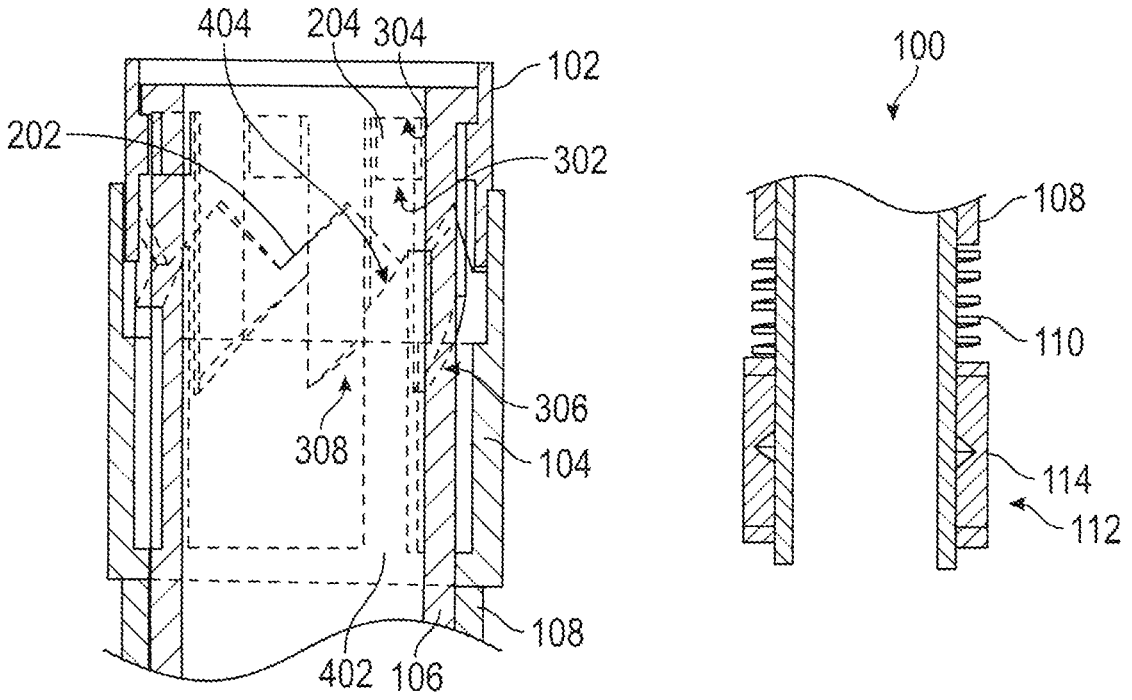

FIG. 5G shows the RCD system 100 in a packer unset configuration, in which the rotational cylinder 104 rotates until one or more rotational teeth 402 engage walls 310. In the illustrated embodiment, the rotational teeth 402 engage the slots 302 of the guide cylinder 106 and the drive teeth 202. The rotational cylinder 104 moves upward within the slot 302, allowing the packer element 114 to return to its uncompressed state. The rotational cylinder 105 and the drive cylinder 102 are prevented from further movement upward by the lugs 204 and the stop surfaces 304. In the illustrated embodiments of FIGS. 5A-5G, the rotational cylinder 104 rotates 90 degrees to complete its cycle and return to the resting state. In some embodiments, the rotational cylinder 104 can rotate more than 90 degrees or less than 90 degrees for a single cycle.

Further, while FIGS. 5A-5G depict an example operation of the RCD control tool 150 to adjust the sealing element 112, the RCD control tool 150 could similarly work to adjust the latch 154. In at least one embodiment, the RCD system 100 includes a rotating cam latch and cam slots that allow dogs to be actuated to protrude out of the slots and retracted into the slots. In at least one embodiment, pistons or other compensators are installed to translate the rotational movement of the rotational cylinder 104 to drive the dogs in and out on the same plane. In some embodiments, the rotational cylinder 104 includes a tooth profile on its outside diameter (OD) or its inside diameter (ID) that engages slots on a cam ring. As the vertical input into the mechanical RCD control tool 150 causes the rotational cylinder 104 to translate vertically as well as rotate, the teeth on the rotational cylinder 104 slide up and down in the slots on the cam ring. Since the rotational ring 104 is allowed to translate vertically relative to the cam ring only the rotational motion of the rotational cylinder 104 is passed on to the cam ring. As the cam ring rotates a series of guide pins connected to push rods, which are connected to locking dogs, are driven radially inward and radially outward. Each time a single actuation of the mechanical RCD control tool 150 occurs the cam ring is caused to rotate and the guide pins, push rods, and dogs are either shifted radially inward or outward. A subsequent actuation of the mechanical RCD control tool 150 returns the guide pins, push rods, and dogs to their previous position.

FIGS. 6A-6E depict an example mechanical RCD control tool 600 in various operational positions, in accordance with some embodiments. The mechanical RCD control tool 600 includes a drive cylinder 602, a rotational cylinder 604, and a guide cylinder 606. To avoid confusion, each of the cylinders 602, 604, 606 are shown with ends rather than broken lines. However, it should be understood that each of FIGS. 6A-6E may show a portion of the control system 600, rather than the control system 600 in its entirety. For example, in some embodiments, one or more of the cylinders 602, 604, 606 may extend downward or upward beyond what is depicted in FIGS. 6A-E. For the purpose of illustration, the guide cylinder 606 is depicted transparently, such that features of the drive cylinder 602, features of the rotational cylinder 604, and interior features of the guide cylinder 606 can be seen through the exterior of the guide cylinder 606.

The drive cylinder 602 includes a plurality of drive teeth 608. The rotational cylinder 604 includes a plurality of rotational teeth 610, 612, configured to engage the drive teeth 608 of the drive cylinder 602. In at least one embodiment, the rotational teeth 610, 612 include deep rotational teeth 610 and shallow rotational teeth 612, such that at least a portion of each of the deep rotational teeth 610 is positioned deeper than the shallow rotational teeth. In some embodiments, at least a portion of each of the deep rotational teeth 610 is positioned upward relative to the position of the shallow rotational teeth 612. The guide cylinder 606 includes a plurality of angled edges 614, 616 and a plurality of walls 618. In some embodiments, the plurality of walls 618 are configured to selectively prevent the rotational cylinder 604 from rotating in at least one direction. In at least one embodiment, the plurality of angled edges 614, 616 include a set of deep angled edges 614 and a set of shallow angled edges 616, such that at least a portion of each deep angled edge 614 is positioned deeper than the shallow angled edges 616. In some embodiments, at least a portion of each deep angled edge 614 is positioned upward relative to the position of the shallow angled edges 616.

In the illustrated embodiments of the mechanical RCD control tool 600, the drive cylinder 602 and the rotational cylinder 604 are housed within the guide cylinder 606. As such, the angled edges 614, 616 and walls 618 are positioned on an interior surface of the guide cylinder 606. However, other configurations will be understood by those of ordinary skill in the art without requiring further enumeration of each possible configuration. The drive cylinder 602, the rotational cylinder 604 and the guide cylinder 606 operate to adjust one or more latch assembly components (e.g., the sealing element 112 and the latch 154 described with reference to FIG. 1) between at least two settings based solely on mechanical engagement. In some embodiments, the rotational cylinder 604 is cycled. In at least one embodiment, the mechanical RCD control tool 600 includes one or more elements or features described with reference to the RCD system 100 of FIG. 1.

Figure 6A:
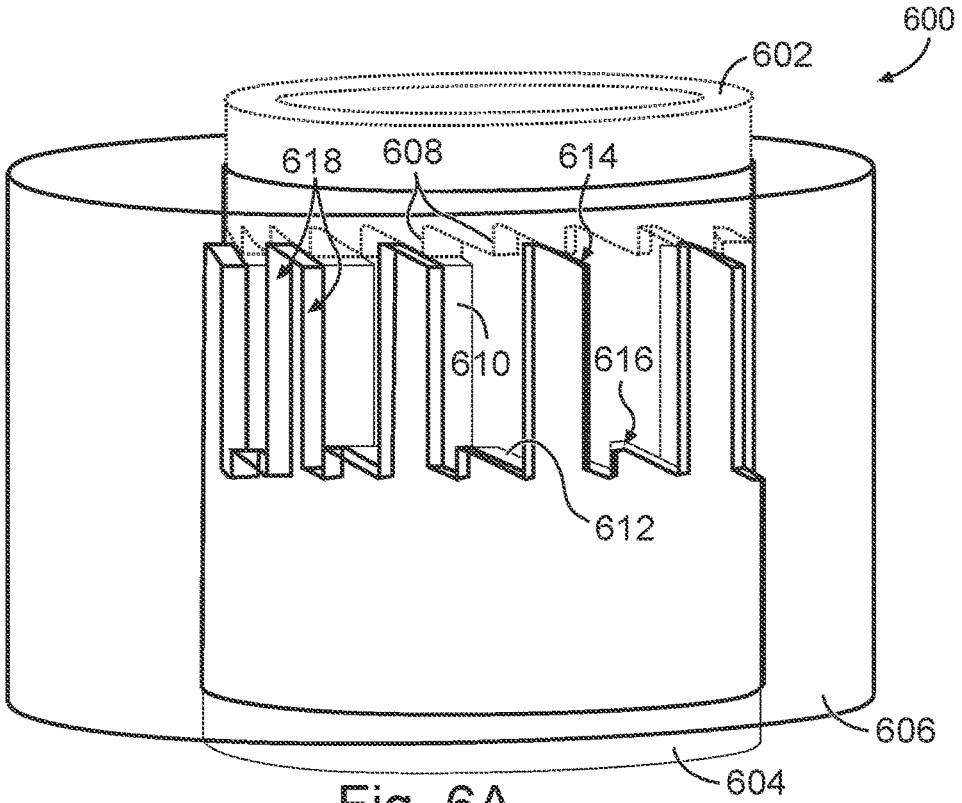
FIGS. 6A-6E are cross-sectional views of an example mechanical RCD control tool in various operational positions, in accordance with some embodiments.

FIG. 6A shows the mechanical RCD control tool 600 in a resting state, or a running configuration, without the application of a longitudinal force on the drive cylinder 602. In at least one embodiment, the rotational cylinder 604 is biased upward by a bias element. In the illustrated embodiment, the rotational deep rotational teeth 610 are engaging the drive teeth 608 and the deep angled edges 614, while the shallow teeth 612 are engaging the shallow angled edges 616. As such, the guide cylinder 606 prevents rotational movement of the rotational cylinder 604. In some embodiments, the deep rotational teeth 610 do not engage the drive teeth 608 in the running configuration.

Figure 6B:
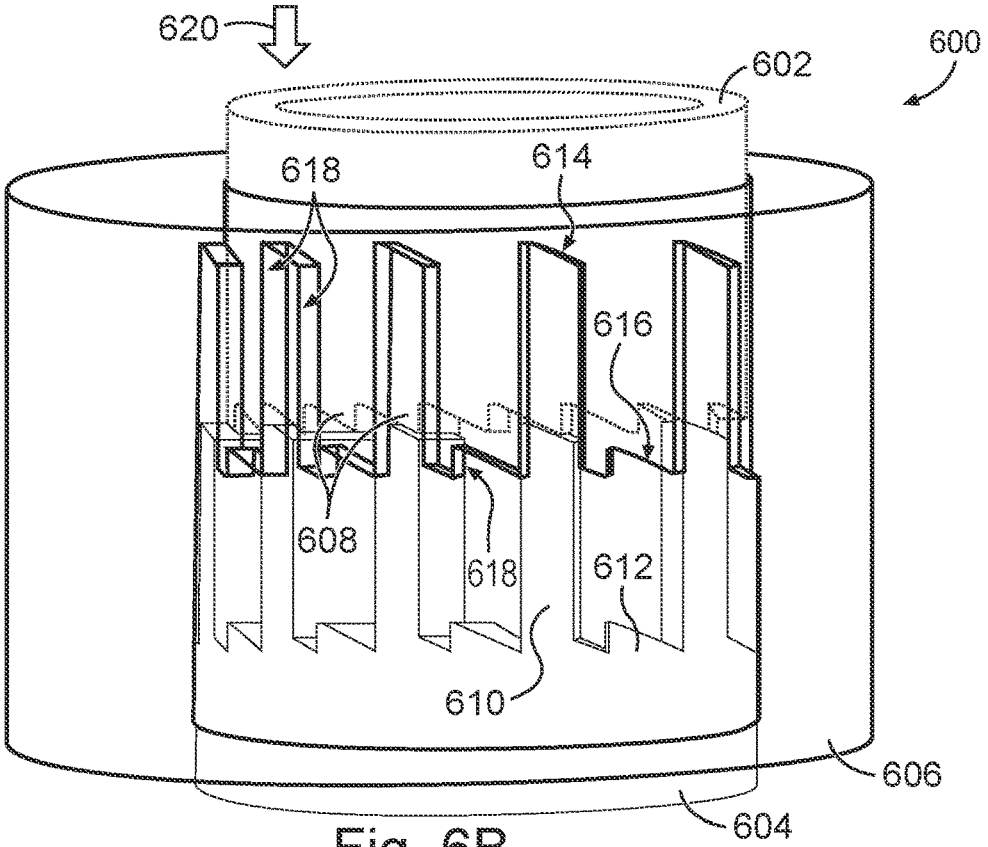

FIG. 6B shows a latch assembly component setting position, in which the mechanical RCD control tool 600 sets a latch assembly component responsive to a first downward longitudinal force 620. The downward longitudinal force 620 urges the drive cylinder 602 in the downward direction. The drive teeth 608 engage the deep rotational teeth 610, such that the drive cylinder 602 urges the rotational cylinder 604 in the downward direction. The drive cylinder 602 drives the rotational cylinder 604 downward, such that the deep rotational teeth 610 clear the walls 618 of the guide cylinder 606, and the rotational cylinder 604 can rotate about its axis. At this point, in at least one embodiment, the latch assembly component is set, and the bias element is compressed.

Figure 6C:
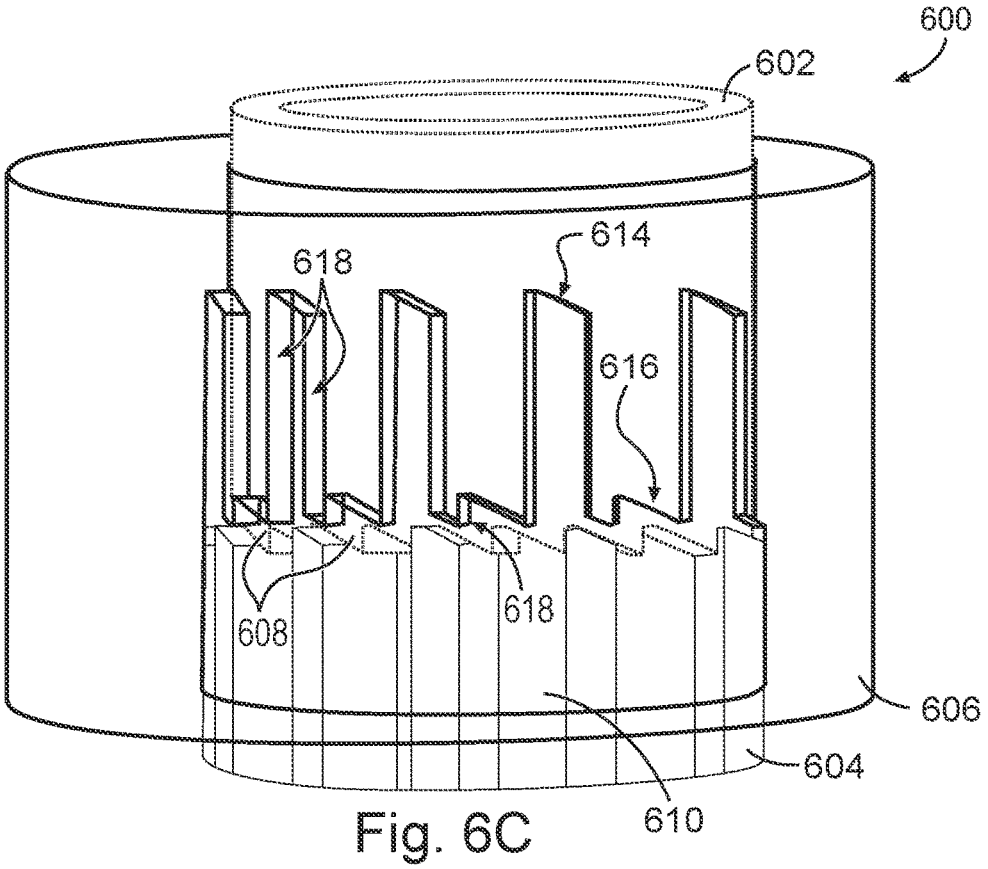

FIG. 6C shows the mechanical RCD control tool 600 after the downward longitudinal force 620 is reduced or removed. The deep rotational teeth 610 are positioned downward relative to the position of the walls 618, and the rotational cylinder 604 begins to rotate as the bias element extends. As the rotational cylinder 604 rotates, the deep rotational teeth 610 slide along the drive teeth 608 until the deep rotational teeth 610 are completely seated within drive teeth 608, preventing further rotation of the rotational cylinder 604.

Figure 6D:
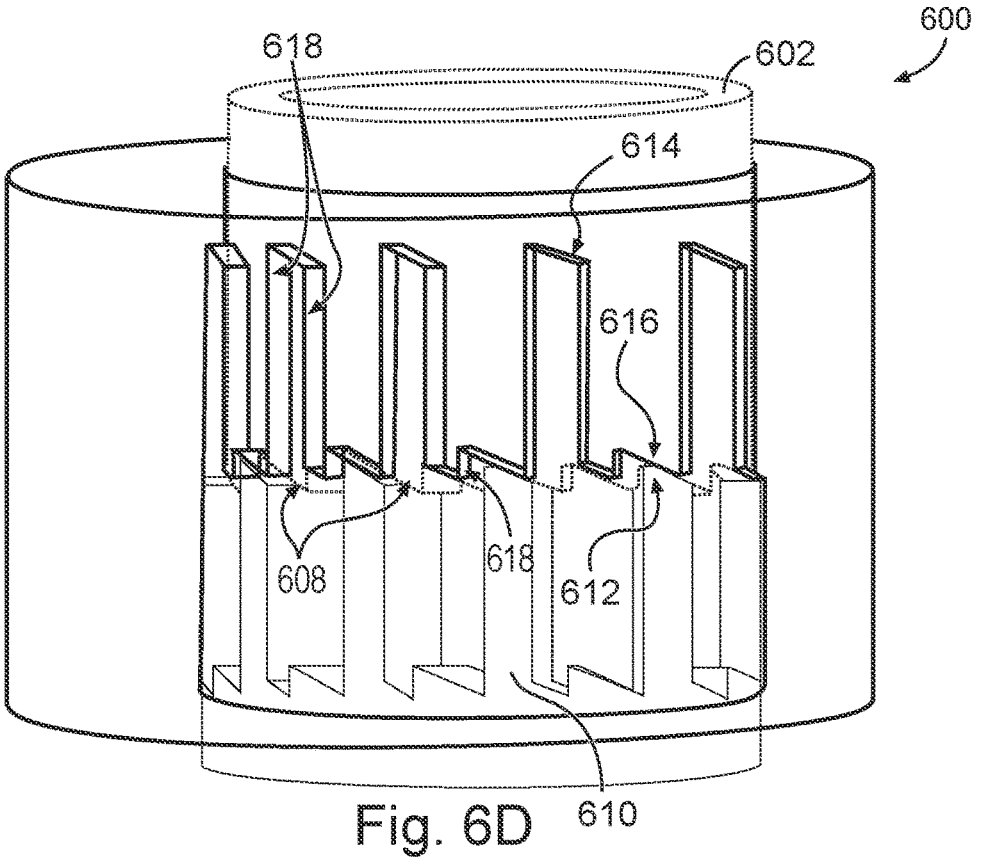

FIG. 6D shows the drive cylinder 602 urged upward (for example, by an external force). The rotational cylinder 604 is locked in the rotational direction by the engagement of the deep rotational teeth 610 with the drive teeth 608 until the deep rotational teeth 610 engage the shallow angled edges 616 of the guide cylinder 606 as the drive cylinder 602 moves upward. In at least one embodiment, the guide cylinder 606 remains relatively stationary. That is, the guide cylinder 606 does not move in a longitudinal or a rotational direction relative to the RCD control system 600. As such, when the deep rotational teeth 610 engage the shallow angled edges 616, the rotational cylinder 604 does not urge the guide cylinder 606 in the upward direction.

Figure 6E:
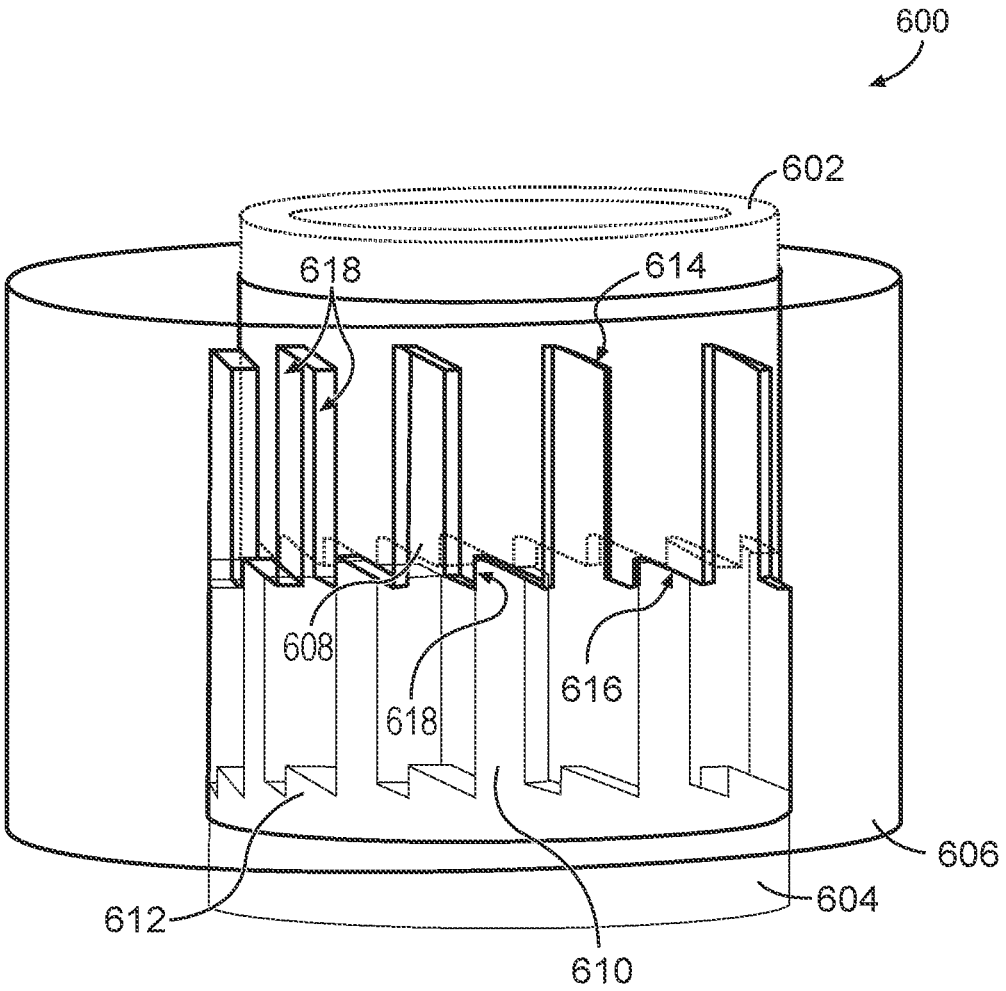

FIG. 6E shows the deep rotational teeth 610 of the rotational cylinder 604 engaging the shallowed angled edges 616 of the guide cylinder 606, such that the rotational cylinder 604 rotates until stopped by one or more walls 618. In at least one embodiment, this represents a locked position of the mechanical RCD control tool 600. In some embodiments, the latch assembly component is set, the bias element is in a compressed position, the rotational cylinder 604 is prevented from rotating, and the mechanical RCD control tool 600 is locked until a subsequent downward force is applied to the drive cylinder 602.

A subsequent downward force applied to the drive cylinder 602 would cause the drive teeth 608 to engage the deep rotational teeth 610 to urge the rotational cylinder 604 downward, unsetting the latch assembly component and compressing the bias element when the deep rotational teeth 610 are positioned downward relative to the position of the walls 618. When the subsequent downward force is reduced or removed, the bias element extends, and the rotational cylinder 604 rotates as the deep rotational teeth 610 slide along a surface of the drive teeth 608. When the deep rotational teeth 610 are fully seated in the drive teeth 608, and the rotational cylinder 604 is prevented from rotating. In at least one embodiment, an external force is used to move the drive cylinder 602 in an upward direction to allow the bias element to extend, causing the rotational cylinder 604 to rotate. The drive cylinder 602 is forced upward until the deep rotational teeth 610 engage the guide cylinder 606, and the RCD control system 600 returns to the resting position show in FIG. 6A.

While the mechanical RCD control tool 600 is described with reference to a downward longitudinal force, it will be understood by those of ordinary skill in the art, that the mechanical RCD control tool 600 could be configured for operation with an upward longitudinal force. While the operation of the rotational cylinder 604 is described with reference to a clockwise rotation, it will be understood by those of ordinary skill in the art that the mechanical RCD control tool 600 could be configured such that the rotational cylinder 604 rotates in a counterclockwise direction.

It will be understood by those of ordinary skill in the art that one or more elements of the RCD control systems described with reference to FIGS. 1-6E can be combined in any of a variety of configurations. For example, in some embodiments, one RCD control tool can be used to control more than one latch assembly component. In some embodiments, multiple RCD control tools can be used to adjust separate components of the latch assembly. In at least one embodiment, a first RCD control tool configured to be housed within the RCD body is configured to adjust a first latch assembly component (e.g., a seal, a latch, or the like), while a second RCD control tool configured to be housed within the RCD body is configured to adjust a second latch assembly component (e.g., a seal, a latch, or the like). In at least one embodiment, a first RCD control tool is configured to adjust a seal (e.g., a packer seal), while a second RCD control tool is configured to adjust a latch. For example, in some embodiments, the second RCD control tool adjusts the latch from an unlatched configuration to a latched configuration by causing one or more latch dogs to extend radially outward such that they engage a receiving profile in the RCD body.

Figure 7:
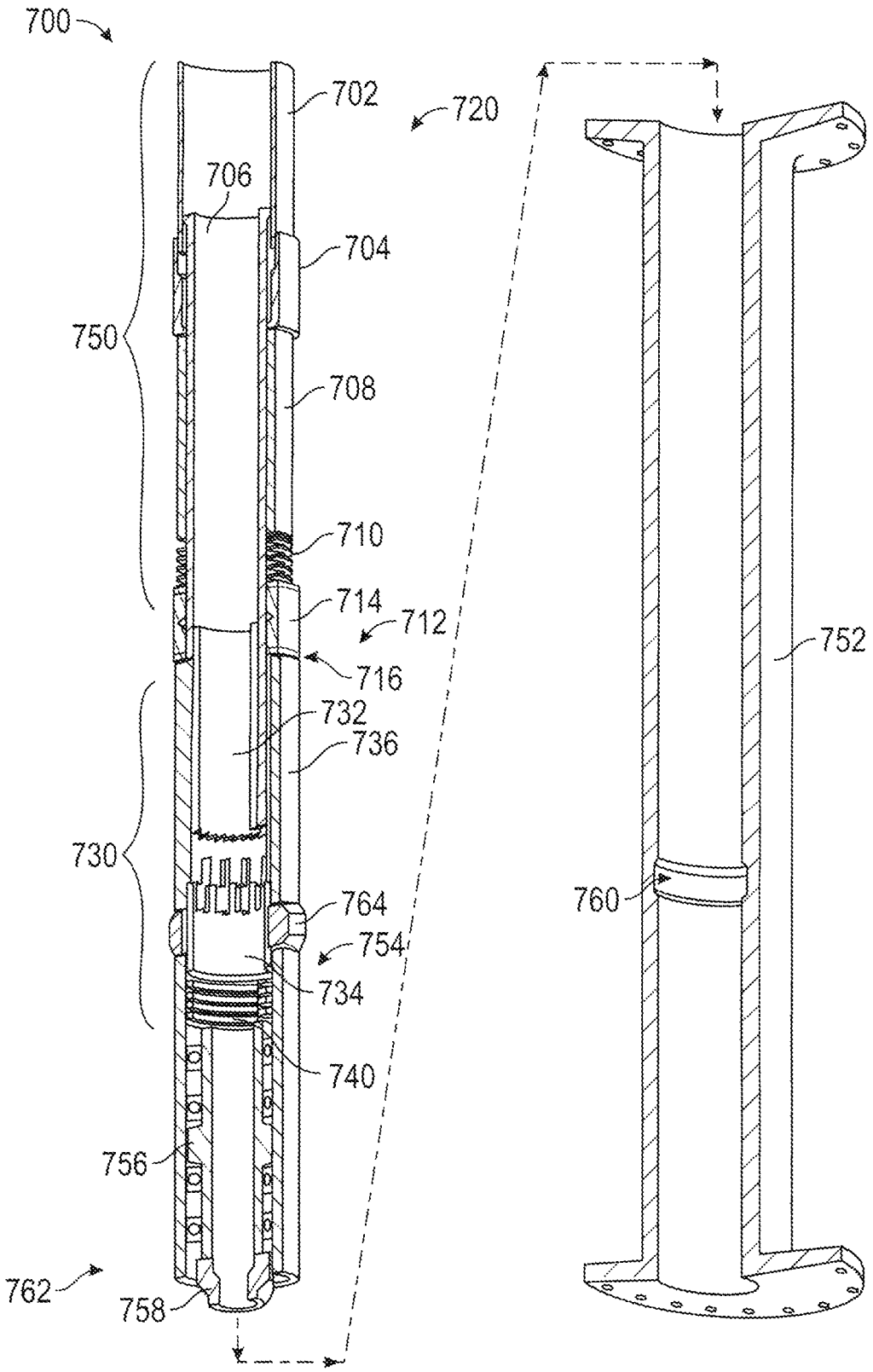
FIG. 7 is a cross-sectional view of an example RCD system, in accordance with some embodiments.

FIG. 7 depicts an example rotating control device (RCD) system 700, in accordance with some embodiments. The RCD system 700 comprises a latch assembly 720, an RCD body 752, and an RCD tool 762. The latch assembly 720 includes a first mechanical RCD control tool 730, a second mechanical RCD control tool 750 and two or more latch assembly components, for example, a seal 712 and a latch 754. The body 752 houses the latching assembly 720 and tool 762 and diverts flow. The latch 754 allows tools 762 to be installed into, and uninstalled from, the body 752. The tool 752 can comprise any of a variety of tools configured to perform any of a variety of functions. In the illustrated embodiment, the tool 762 is a bearing assembly 756 configured to allow drill pipe to spin inside the RCD body 752 while holding a seal, via sealing element 758, between the RCD 762 and the drill pipe. In at least one embodiment, the tool 762 comprises an inner housing with a rotating member 756, such that the RCD body 752 is configured to receive the inner housing with the rotating member 756. In at least one embodiment, the latch assembly 720 is configured to couple the inner housing with the rotating member 756 to the RCD body 752.

In some embodiments, the first mechanical RCD control tool 730 allows for remote mechanical operation of the latch 754. In some embodiments, the first RCD control tool 730 includes a drive cylinder 732, a rotational cylinder 734, and a guide cylinder 736. In some embodiments, the first RCD control tool 730 includes an intermediate cylinder disposed between a bias element 740 and the rotational cylinder 734. In at least one embodiment, the intermediate cylinder transfers forces between the rotational cylinder 734 and the bias element 740. In the some embodiments, the rotational cylinder 734 is directly coupled to the bias element 740, and an intermediate cylinder is not included.

In some embodiments, the first RCD control tool 730 is configured to adjust the latch 754 between at least two settings. For example, in at least one embodiment the first RCD control tool 730 can adjust the latch 754 back and forth between active and inactive positions. In some embodiments, the first RCD control tool 730 can adjust the latch 754 between more than two settings. In at least one embodiment, the first RCD control tool 730 can cycle repeatedly through a plurality of settings for the latch 754. In some embodiments, the first RCD control tool 730 can set and unset the latch 754.

In at least one embodiment, the first mechanical RCD control tool 730 adjusts the latch 754 from a latched configuration to an unlatched configuration and from the unlatched configuration to the latched configuration. In some embodiments, the latch 754 is a rotary cam latch. In at least one embodiment, the rotary cam latch 754 is configured to spin to cause latch dogs 764 to protrude and retract to set and unset tools within the RCD body 752. When the first mechanical RCD control tool 730 adjusts the latch dogs 164 from the retracted configuration to the protruding configuration, the latch dogs 764 engage a corresponding profile 160 (e.g., a recess) in the RCD body 752. In at least one embodiment, the combination of the first RCD control tool 730 and the latch 754 allows an operator to install and uninstall (set and unset) a tool 762 (e.g., bearing assembly, casing stripper adapter, seal bore protector, or the like) in the RCD body 752 without the need for tool-specific running/retrieving instruments.

In some embodiments, the second mechanical RCD control tool 750 allows for remote mechanical operation of the sealing element 712. In some embodiments, the second RCD control tool 750 includes a drive cylinder 702, a rotational cylinder 704, and a guide cylinder 706. In some embodiments, the second RCD control tool 750 includes an intermediate cylinder 708 disposed between a bias element 710 and the rotational cylinder 704. In at least one embodiment, the intermediate cylinder 708 transfers forces between the rotational cylinder 704 and the bias element 710. In some embodiments, the rotational cylinder 704 is directly coupled to the bias element 710, and an intermediate cylinder 708 is not included.

In some embodiments, the second RCD control tool 750 is configured to adjust the sealing element 712 between at least two settings. For example, in at least one embodiment the second RCD control tool 750 can adjust the sealing element 712 back and forth between active and inactive positions. In some embodiments, the second RCD control tool 750 can adjust the sealing element 712 between more than two settings. In at least one embodiment, the second RCD control tool 750 can cycle repeatedly through a plurality of settings for the sealing element 712. In some embodiments, the second RCD control tool 750 can set and unset the sealing element 712.

In the illustrated embodiment, the sealing element 712 includes a packer element 714 and a packer retaining ring 716, such that the second RCD control tool 750 can adjust the packer element 714 from a compressed configuration to an uncompressed configuration and from the uncompressed configuration to the compressed configuration. In the present disclosure, the terms "compressed" and "uncompressed" are relative terms, such that "compressed" means more compressed and "uncompressed" means less compressed. In at least one embodiment, the combination of the second RCD control tool 750 and the packer element 714 allows an operator to maintain a seal between the RCD body 752 and a tool 762 (e.g., bearing assembly, casing stripper adapter, seal bore protector, or the like) installed in the RCD body 752 without the need for tight tolerances or pristine sealing surface conditions.

In some embodiments, the cylinders 702, 704, 706, 732, 734, 736 of the first and second RCD control tools 730, 750 are arranged differently than depicted in FIG. 7. For example, while the first RCD control tool 730 depicts the drive cylinder 732 and the rotational cylinder 734 interior to the guide cylinder 736, in other embodiments, the guide cylinder 736 can be interior to the drive cylinder 732 and the rotational cylinder 734. Further, while the second RCD control tool 750 depicts the drive cylinder 702 and the rotational cylinder 704 exterior to the guide cylinder 706, in other embodiments, the guide cylinder 706 can be exterior to the drive cylinder 702 and the rotational cylinder 704. Further, the number of teeth and grooves for each cylinder may differ in different embodiments. In some embodiments, the first RCD control tool 730 has a design similar to that of the second RCD control tool 750.

In some embodiments, each of the RCD control tools of any of FIGS. 1-7 can be actuated by a longitudinal force applied to the drive cylinder. In at least one embodiment, a running tool can be used to apply the longitudinal force to the drive cylinder to remotely and mechanically actuate the RCD control tool and adjust one or more components of the RCD latch assembly.

Figure 8:
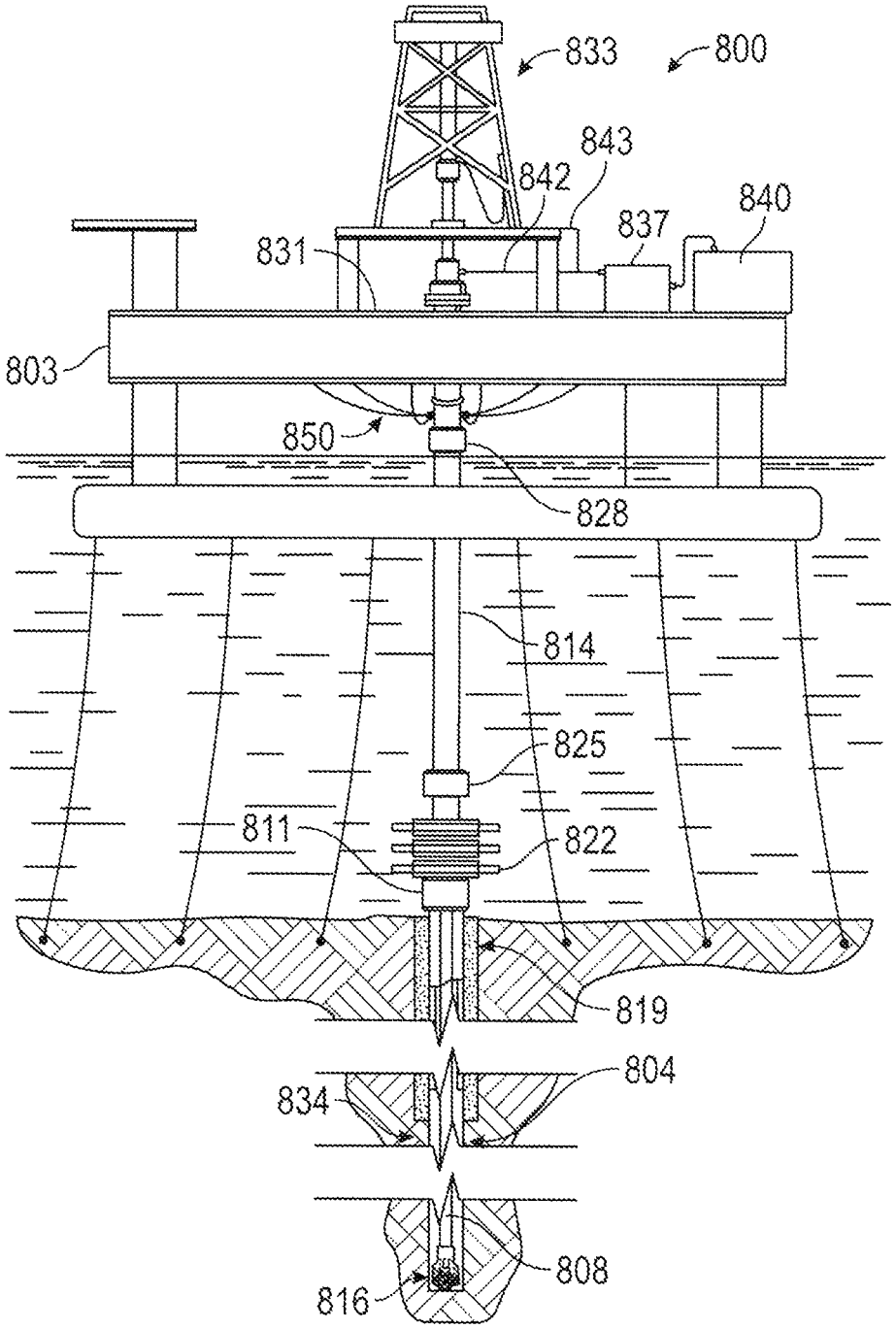
FIG. 8 is a diagram of an offshore rig that includes an RCD system, in accordance with some embodiments.

FIG. 8 shows a subsea drilling system 800 comprising a drilling installation that includes an offshore floating semi-submersible drill rig 803 which is used to drill a subsea borehole 804 by means of a drill string 808 suspended from and driven by the drill rig 803. In other embodiments, the disclosed method and apparatus may be used in different drill rig configurations, including both offshore and land drilling.

The drill string 808 comprises sections of drill pipe suspended from a drilling platform 833 on the drill rig 803. A downhole assembly or bottom hole assembly (BHA) at a bottom end of the drill string 808 includes a drill bit 816 which is driven at least in part by the drill string 808 to drill into Earth formations, thereby piloting the borehole 804. Part of the borehole 804 may provide a wellbore 819 that comprises a casing hung from a wellhead 811 on the seafloor. In the illustrated embodiment, a marine riser 814 extends from a blowout preventer (BOP) stack 822 positioned above the wellhead 811 to the drill rig 803. In this example embodiment, an annular BOP 825 is located on top of the BOP stack 822, and a rotating control device (RCD) system 828 (which may include any one or more of the elements of FIGS. 1-7) is positioned above the annular BOP 825, below a rig floor 831 provided by the drilling platform 833. In some embodiments, the RCD system 828 may be positioned in the drilling riser 814, below a riser tensioning system 850 (e.g., the system that supports weight of riser as well as compensates for relative motion between riser and rig), or the like. In some embodiments, the riser tensioning system 850 includes a tension ring (e.g., the point where the tensioning system is secured to riser) and the RCD system 828 is positioned below the tension ring. In at least one embodiment, the RCD system 828 is positioned more than about 100 feet (30.48 meters) below the rig floor 831. In at least one embodiment, the RCD system 828 is positioned more than about 150 feet (45.72 meters) below the rig floor 831. In some embodiments, the RCD system 828 is positioned below the water line or in the splash zone.

Thus, in the illustrated embodiment, the drill string 808 extends from the rig floor 831, through the riser, the tensioning system 850, the RCD 828 (which may include any one or more of the elements of FIGS. 1-7), the annular BOP 825, the BOP stack 822, the wellhead 811, the wellbore casing, and along the borehole 804. Each of these structures or formations through which the drill string 808 extends respectively provides a passage through which the drill string 808 extends with radial clearance, forming an annular space (further referred to as "the annulus" and indicated by reference number 834) defined between a radially outer surface the drill string 808's drill pipe and a radially inner surface of the respective structures/formations.

Drilling fluid (e.g. drilling "mud," or other fluids that may be in the well, and also referred to as "drilling fluid") is circulated downhole via a hollow interior of the drill string 808, and upward via the annulus 834. A pump system 837 delivers pressurized drilling fluid from a mud tank 840 on the drill rig 803 to a supply line 843 connected to the drill string 808's interior drilling fluid conduit at the drilling platform 833. Drilling fluid from the annulus 834 returns to the pump system 837 and/or to the mud tank 840 through a return line 842 that is in fluid flow connection with the annulus 834 via the RCD 828. The drilling fluid is forced along the drill pipe of the drill string 808 towards its downhole end, where the drilling fluid exits under high pressure through the drill bit 816. After exiting from the drill string 808, the drilling fluid occupies the annulus 834 and moves upward along the annulus 834 due to continued delivery of drilling fluid to the drill string 808 by the pump system 837. Drilling fluid in the annulus 834 carries cuttings from the bottom of the borehole 804 to the RCD 828, where the returning drilling fluid is diverted via the return line 842. The annular BOP 825 and the BOP stack 822 provide protection against blowout via the annulus 834 because of sudden pressure increases which may occur in the borehole 804. If, for instance, pressurized geological formations are encountered during drilling operations, a sudden release of gas, for example, can result in potentially disastrous fluid pressure spikes in the annulus 834.

The outer diameter of the annulus 834 is defined in the borehole 804 by a substantially cylindrical borehole wall having a substantially circular cross-sectional outline that remains more or less constant along the length of the borehole 804. A passage in the RCD 828 is likewise substantially circular cylindrical.

In offshore embodiments, such as the subsea drilling system 800, the RCD system 828 may be difficult to access. For example, since the rig is floating, the rig may experience ocean heave (e.g., vertical motion due to ocean state), and the RCD system 828 may be positioned such that a person cannot access the RCD system to manually adjust components of the RCD system up close. As such, in some embodiments, one or more tools of the RCD system 828 must be lowered into the body of the RCD system 828. Further, in at least one embodiment, components of the RCD system 828 can be remotely and mechanically actuated.

In some embodiments, the RCD system 828 (which may include any one or more of the elements of FIGS. 1-7) comprises an RCD body and a latch assembly. In at least one embodiment, the latch assembly includes a mechanical RCD control tool, a latch, and a seal. In some embodiments, a running and pulling tool is used to provide a longitudinal force to the mechanical RCD control tool. In at least one embodiment, the mechanical RCD control tool adjusts the latch from a latched configuration to an unlatched configuration, and from the unlatched configuration to the latched configuration. In at least one embodiment, the latch is a rotary cam latch. In some embodiments the mechanical RCD control tool adjusts the sealing element from a sealed configuration to an unsealed configuration, and from the unsealed configuration to the sealed configuration. In at least one embodiment, the sealing element is a packer element. In some embodiments, the sealing element provides a seal between a tool and the body of the RCD. In at least one embodiment, the sealing element provides a seal between a bearing assembly and the body of the RCD.

While FIG. 8 generally illustrates a semisubmersible example, embodiments described herein may be used in other offshore (e.g., drill ships, jack-up rigs, etc.) or land-based environments as well. Further, offshore and land-based operations may include use of wireline or LWD/MWD apparatus and techniques including at least those described herein.

Thus, many embodiments may be realized. Some of these will now be listed as non-limiting examples. The following numbered examples are illustrative embodiments.

1. A system, including a latch assembly configured to be inserted into a body of a rotating control device (RCD), the latch assembly including a latch adjustable between a latched configuration and an unlatched configuration, the latch configured to releasably couple a tool to the body, a sealing element adjustable between a sealed configuration and an unsealed configuration, the sealing element configured to provide a seal between the body and the tool, and a mechanical RCD control tool configured to adjust at least one component of the latch assembly between at least two settings based solely on mechanical engagement of components of the RCD control tool.

2. The system of example 1, wherein the mechanical RCD control tool is configured to adjust the at least one component of the latch assembly from a first setting to a second setting and from the second setting to the first setting.

3. The system of example 1 or example 2, wherein the mechanical RCD control tool includes a rotational cylinder including a plurality of rotational teeth, wherein the rotational cylinder is configured to rotate in a rotational direction to adjust the at least one component of the latch assembly, a drive cylinder including a plurality of drive teeth configured to engage the rotational teeth to urge the rotational cylinder against a bias element, and a guide cylinder including a plurality of angled edges configured to receive the rotational teeth and releasably lock the rotational cylinder in at least two rotational positions.

4. The system of example 3, wherein adjustment of the at least one component of the latch assembly is based solely on mechanical engagement of the rotational cylinder, the drive cylinder, and the guide cylinder, responsive to application of a longitudinal force to the drive cylinder.

5. The system of any preceding example, wherein the RCD control tool is configured to adjust the latch from the latched configuration to the unlatched configuration and from the unlatched configuration to the latched configuration.

6. The system of any of examples 1-4, wherein the RCD control tool is configured to adjust the sealing element from the sealed configuration to the unsealed configuration, and from the unsealed configuration to the sealed configuration.

7. The system of any of examples 6, wherein the RCD control tool is configured to adjust the latch from the latched configuration to the unlatched configuration and from the unlatched configuration to the latched configuration.

8. The system any preceding example, wherein the RCD control tool includes a first control element and a second control element, the first control element configured to adjust the sealing element between the sealed configuration and the unsealed configuration, the second control element configured to adjust the latch between the latched configuration and the unlatched configuration.

9. The system of any preceding example, wherein the tool includes a bearing assembly, a casing stripper assembly, or a seal bore protector.

10. The system of any preceding example, wherein the latch includes a rotary cam latch.

11, The system of any preceding example, wherein the sealing element includes a packer element, such that the packer element is compressed in the sealed configuration.

12. The system of any preceding example, wherein the RCD control tool is configured to be remotely and mechanically actuated.

13. The system of any preceding example, wherein the tool includes the latch assembly.

14. The system of any preceding example, further including the body of the RCD, wherein the body is configured to receive the latch assembly and the tool.

15. An apparatus, including a rotational cylinder including a plurality of rotational teeth, a drive cylinder including a plurality of drive teeth configured to engage the rotational teeth to urge the rotational cylinder against a bias element, and a guide cylinder including a plurality of angled edges configured to receive the rotational teeth and releasably lock the rotational cylinder in at least two rotational positions, wherein the rotational cylinder is configured to rotate to adjust a rotating control device (RCD) latch assembly component between at least two settings based on movement of the drive cylinder in a selected direction.

16. The apparatus of example 15, wherein the plurality of angled edges include deep angled edges and shallow angled edges, such that at least a portion of each deep angled edge is positioned further in the direction opposite the selected direction than the shallow angled edges.

17. The apparatus of example 15 or example 16, wherein the guide cylinder includes a locking element configured to selectively prevent rotational movement of the rotational cylinder.

18. The apparatus of any of examples 15-17, wherein the apparatus includes part of the RCD latch assembly.

19. The apparatus of any of examples 15-18, further including an intermediate cylinder disposed between the spring and the rotational cylinder, the intermediate cylinder configured to move in the selected direction and the direction opposite the selected direction, based on compression and extension of the spring, respectively.

20. The apparatus of any of examples 15-19, wherein the RCD latch assembly includes a latch adjustable between a latched position and an unlatched position, the latch configured to releasably couple at least one tool to an RCD body, and a sealing element adjustable between a sealed position and an unsealed position, the sealing element configured to provide a seal between the tool and the RCD body.

21. A method, including engaging a first set of drive teeth of a drive cylinder, with a plurality of rotational teeth of a rotational cylinder, while a rotating control device (RCD) latch assembly component is in a first setting, applying a first force to the drive cylinder in a selected direction to urge the rotational cylinder in the selected direction against a bias element, moving the drive cylinder in the selected direction to move the rotational teeth past a first set of angled edges of a guide cylinder, such that the rotational cylinder rotates about its longitudinal axis in a rotational direction, and reducing the first force applied to the drive cylinder, such that the drive cylinder moves in a direction opposite the selected direction and the rotational teeth engage the first set of angled edges of the guide cylinder to rotatably adjust the RCD latch assembly component from the first setting to a second setting.

22. The method of example 21, wherein reducing the first force causes the rotational cylinder to rotate about its longitudinal axis in the rotational direction.

23. The method of example 21 or example 22, further including applying a second force to the drive cylinder in the selected direction to urge the rotational cylinder against the bias element, such that a second set of drive teeth of the drive cylinder engage the plurality of rotational teeth of the rotational cylinder while the RCD latch assembly component is in the second setting, moving the drive cylinder in the selected direction to move the rotational teeth past a second set of angled edges of a guide cylinder, such that the rotational cylinder rotates about its longitudinal axis in the rotational direction, and reducing the second force applied to the drive cylinder, such that the drive cylinder moves in a direction opposite the selected direction, and the rotational teeth engage the second set of angled edges of the guide cylinder to adjust the RCD latch assembly component from the second setting to a third setting.

24. The method of example 23, wherein the first setting and the third setting are the same.

25. The method of example 23 or example 24, wherein reducing the second force causes the rotational cylinder to rotate about its longitudinal axis in the rotational direction.

26. The method of any of examples 21-25, wherein the first setting includes a latched setting, such that the latch assembly is configured to releasably couple an RCD tool to a body of the RCD, wherein the second setting includes an unlatched setting, such that the latch assembly is configured to decouple the RCD tool from the body of the RCD.

27. The method of any of examples 21-25, wherein the rotational cylinder is prevented from rotating about its longitudinal axis in a direction opposite the rotational direction.

28. The method of any of examples 21-25, further including remotely and mechanically adjusting the latch assembly component.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. An apparatus, comprising:

a rotational cylinder comprising a plurality of rotational teeth;

a drive cylinder comprising a plurality of drive teeth configured to engage the rotational teeth to urge the rotational cylinder against a bias element;

a guide cylinder comprising a plurality of angled edges configured to receive the rotational teeth and releasably lock the rotational cylinder in at least two rotational positions;

wherein the apparatus comprises part of a rotating control device (RCD) latch assembly and the rotational cylinder is configured to rotate to adjust a RCD latch assembly component between at least two settings based on movement of the drive cylinder in a selected direction.

2. The apparatus of claim 1, wherein the plurality of angled edges comprise deep angled edges and shallow angled edges, such that at least a portion of each deep angled edge is positioned further in the direction opposite the selected direction than the shallow angled edges.

3. The apparatus of claim 1, wherein the guide cylinder comprises a locking element configured to selectively prevent rotational movement of the rotational cylinder.

4. The apparatus of claim 1, further comprising an intermediate cylinder disposed between the spring and the rotational cylinder, the intermediate cylinder configured to move in the selected direction and the direction opposite the selected direction, based on compression and extension of the spring, respectively.

5. The apparatus of claim 1, wherein the RCD latch assembly comprises:

a latch adjustable between a latched position and an unlatched position, the latch configured to releasably couple at least one tool to an RCD body; and a sealing element adjustable between a sealed position and an unsealed position, the sealing element configured to provide a seal between the tool and the RCD body.

6. A method, comprising:

engaging a first set of drive teeth of a drive cylinder, with a plurality of rotational teeth of a rotational cylinder, while a rotating control device (RCD) latch assembly component is in a first setting;

applying a first force to the drive cylinder in a selected direction to urge the rotational cylinder in the selected direction against a bias element;

moving the drive cylinder in the selected direction to move the rotational teeth past a first set of angled edges of a guide cylinder, such that the rotational cylinder rotates about its longitudinal axis in a rotational direction; and reducing the first force applied to the drive cylinder, such that the drive cylinder moves in a direction opposite the selected direction and the rotational teeth engage the first set of angled edges of the guide cylinder to rotatably adjust the RCD latch assembly component from the first setting to a second setting.

7. The method of claim 6, wherein reducing the first force causes the rotational cylinder to rotate about its longitudinal axis in the rotational direction.

8. The method of claim 6, further comprising:

applying a second force to the drive cylinder in the selected direction to urge the rotational cylinder against the bias element, such that a second set of drive teeth of the drive cylinder engage the plurality of rotational teeth of the rotational cylinder while the RCD latch assembly component is in the second setting;

moving the drive cylinder in the selected direction to move the rotational teeth past a second set of angled edges of a guide cylinder, such that the rotational cylinder rotates about its longitudinal axis in the rotational direction; and reducing the second force applied to the drive cylinder, such that the drive cylinder moves in a direction opposite the selected direction, and the rotational teeth engage the second set of angled edges of the guide cylinder to adjust the RCD latch assembly component from the second setting to a third setting, wherein the first setting and the third setting are the same, and wherein reducing the second force causes the rotational cylinder to rotate about its longitudinal axis in the rotational direction.

9. The method of claim 6, wherein the first setting comprises a latched setting, such that the latch assembly is configured to releasably couple an RCD tool to a body of the RCD, wherein the second setting comprises an unlatched setting, such that the latch assembly is configured to decouple the RCD tool from the body of the RCD.

10. The method of claim 6, wherein the rotational cylinder is prevented from rotating about its longitudinal axis in a direction opposite the rotational direction.

11. The method of claim 6, further comprising remotely operating the drive cylinder to adjust the latch assembly component.

* * * * *